United States Patent [19]

Copp

[11] 3,955,454

[45] May 11, 1976

[54] EDGE PROXIMITY SENSOR FOR MOVING SHEET

[75] Inventor: Robert M. Copp, Brockton, Mass.

[73] Assignee: Rubin Goldman, Newton Highlands, Mass.

[22] Filed: Oct. 3, 1974

[21] Appl. No.: 511,715

[52] U.S. Cl. ..... 83/368; 83/72

[51] Int. Cl.[2] ..... B26D 5/04

[58] Field of Search ..... 83/368, 72; 226/20; 137/561

[56] References Cited

UNITED STATES PATENTS

| | | | |
|---|---|---|---|
| 3,400,624 | 9/1968 | Holm | 83/368 |
| 3,664,223 | 5/1972 | Brocklehurst | 83/368 |
| 3,741,060 | 6/1973 | Owen | 83/368 |
| 3,753,381 | 8/1973 | Reime et al. | 83/368 X |
| 3,803,961 | 4/1974 | Valente | 83/368 X |

*Primary Examiner*—Frank T. Yost

*Attorney, Agent, or Firm*—Wolf, Greenfield & Sacks

[57] ABSTRACT

A moving web or sheet of material in which an operation is to be performed, such as punching of a hole, is advanced past a pneumatic edge position sensor which is mounted on a carriage for movement transversely toward and away from the edge of the web. The movable carriage also supports the mechanism which is to perform the particular operation (e.g., a hole punching device) and a pneumatic cylinder is connected to the carriage to effect its movement toward or away from the edge of the web to follow any lateral displacement of the web. Operation of the motor is controlled in response to a change in position of the edge of the moving web with respect to the edge position sensor by a pneumatic control system which provides an immediate operation of the motor in response to the sensor and without a hunting tendency.

7 Claims, 8 Drawing Figures

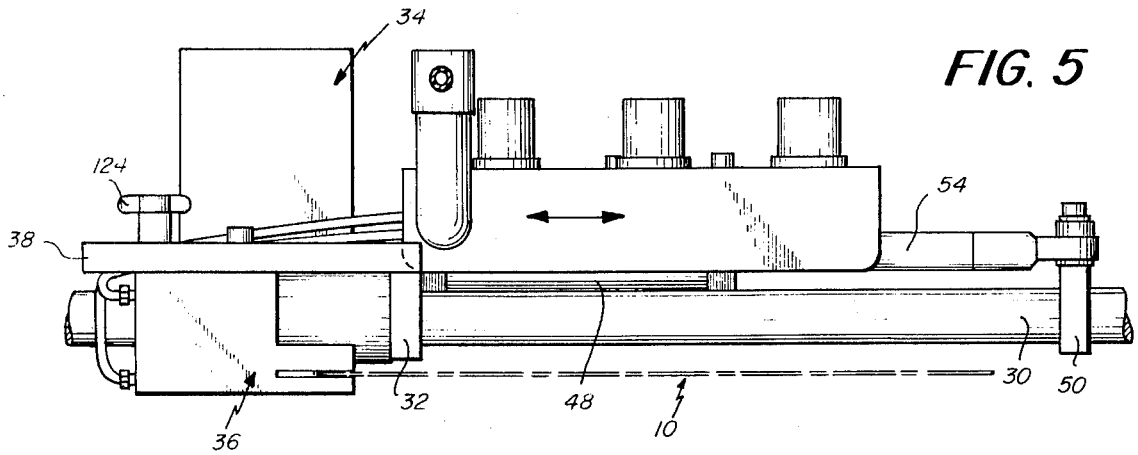
FIG. 5
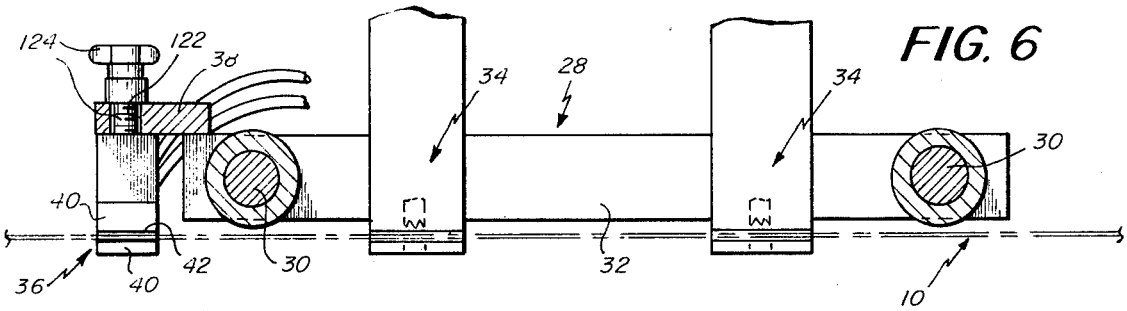
FIG. 6
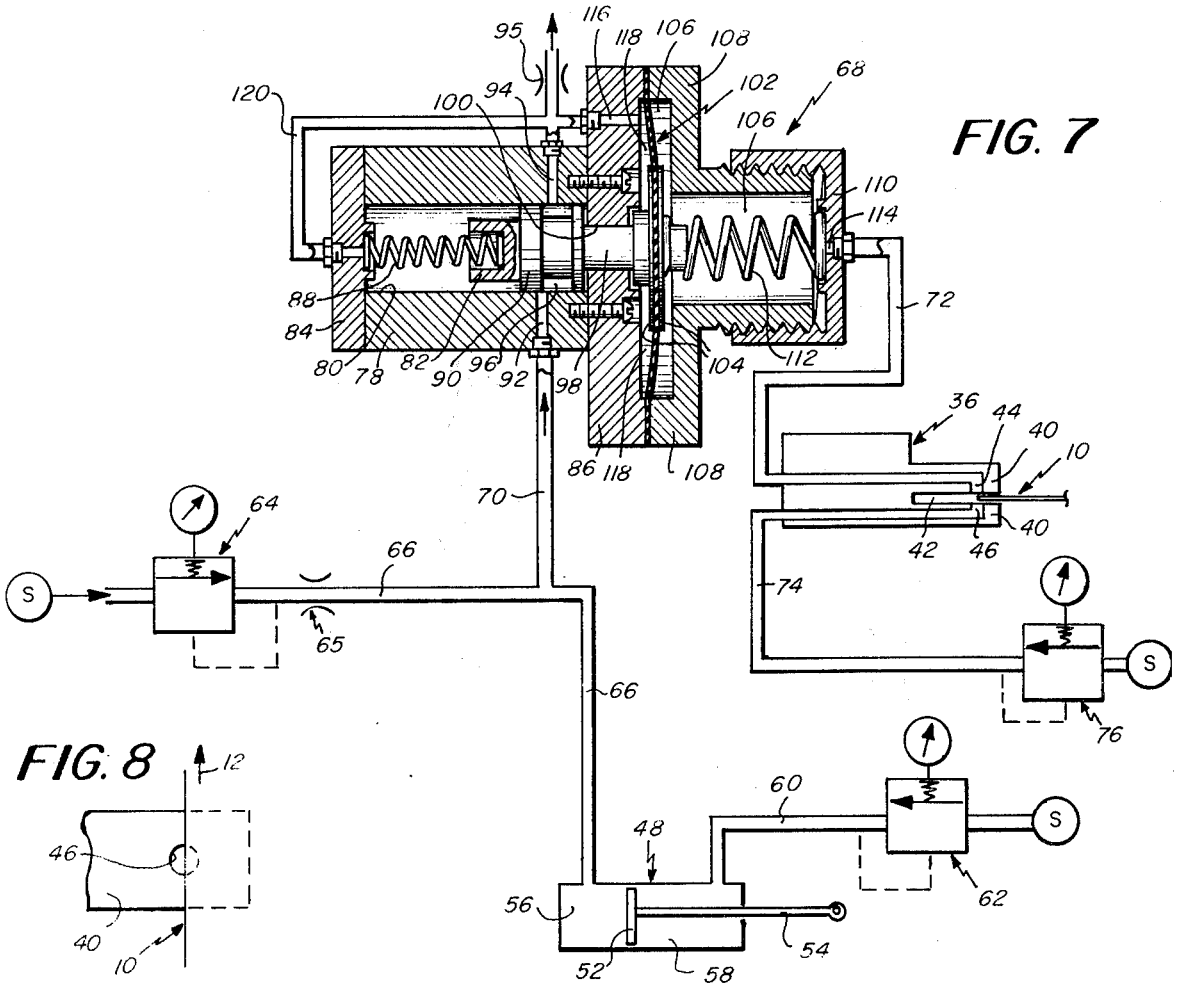
FIG. 7
FIG. 8

EDGE PROXIMITY SENSOR FOR MOVING SHEET

BACKGROUND OF THE INVENTION

A wide variety of manufacturing operations are performed in a variety of industrial environments on sheet material in the form of a moving web in which the web is advanced past various operating stations, each of which performs a particular operation on the web. For example, in the manufacture of some types of packaging bags, as from thin plastic sheeting or the like, it is desirable to punch wicket holes at predetermined spaced locations along the web to facilitate holding the bag while it is being filled with the product to be packaged. In this particular manufacturing operation, the holes must be punched in precisely the correct location so that the bag may be strong enough to hang on the pins or wickets while the bag is being filled. The holes also must be located to enable the bag to be torn from the supporting wickets after the bag has been filled. Proper formation and location of the holes is essential particularly when the bag filling procedure is automated. For example, if the holes are not at precisely the right location and the bag tears prematurely or fails to tear at the proper time, a fully automated packaging system may have to be shut down until suitable repairs and/or adjustments are made.

In general, proper location of such hole punching or similar devices has been effected by a technique employing a proximity sensor to sense the location of the edge of the moving sheet. The sensor device is operatively associated with a control arrangement for continually guiding and repositioning the web toward and away from the operating station. For example, U.S. Pat. Nos. 3,759,457 and 3,785,542 show such prior devices in which the moving web is positioned by shifting rollers and other web guiding devices to move the web toward or away from the operating station. Such techniques are both complex and costly and are not free from difficulty. Moreover, they are generally unsuited for use in environments where the web moves at a relatively high speed because their response times, from the time the location of the edge of the web is sensed to the time the web shifting mechanism is operated, often is too great.

The present invention is intended to overcome the difficulties inherent in such prior systems and in a manner which is relatively simple and inexpensive.

SUMMARY OF THE INVENTION

The mechanism for performing the particular operation of the moving web of sheet material (e.g., a hole punching device) is mounted on a carriage. The carriage is located adjacent the path of web travel and is movable transversely toward and away from the web under the influence of a pneumatic motor. The carriage also carries for movement with it a pneumatic edge sensor which is located so that the web may pass continually through the edge sensor. A pneumatic control circuit is connected between the edge sensor and the pneumatic motor for operating the carriage and is effective to cause the carriage and the mechanism carried thereby, to move toward or away from the web to locate the sensor and, therefore, the hole punching or other mechanism in a proper, predetermined position with respect to the edge of the web. The control circuit includes an improved pneumatic servo-amplifier valve which provides extremely quick response in driving the motor in response to a signal from the web sensing device.

It is among the objects of the invention to provide an improved means for locating a device in a predetermined position with respect to an edge of a moving web.

A further object of the invention is to provide an edge sensing system of the type described which has an extremely fast response time.

Another object of the invention is to provide an improved pneumatic servo-amplifier valve.

Still another object of the invention is to provide a device of the type described which is relatively simple and inexpensive.

DESCRIPTION OF THE DRAWINGS

The foregoing and other objects and advantages of the invention will be understood more fully from the following further description thereof, with reference to the accompanying drawings wherein:

FIG. 5 is a side elevation of the carriage;

FIG. 6 is a sectional view of the carriage as seen along the line 6—6 of FIG. 4;

FIG. 7 is a sectional illustration of the improved pneumatic servo-amplifier valve and the manner in which it is incorporated into the pneumatic control system of the invention; and FIG. 8 is a somewhat diagrammatic illustration of the manner in which the edge of the web cooperates with the edge sensor.

DESCRIPTION OF THE PREFERRED EMBODIMENT

Figure 1:
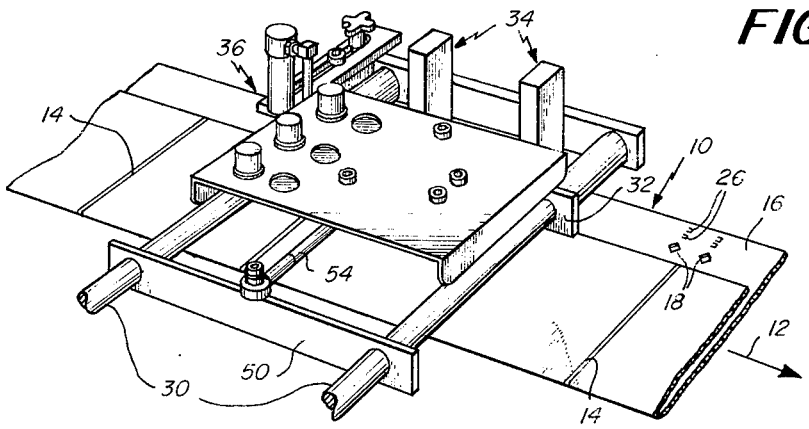
FIG. 1 is an illustration of the moving web of sheet material and the location of the carriage with respect thereto.
Figure 2:
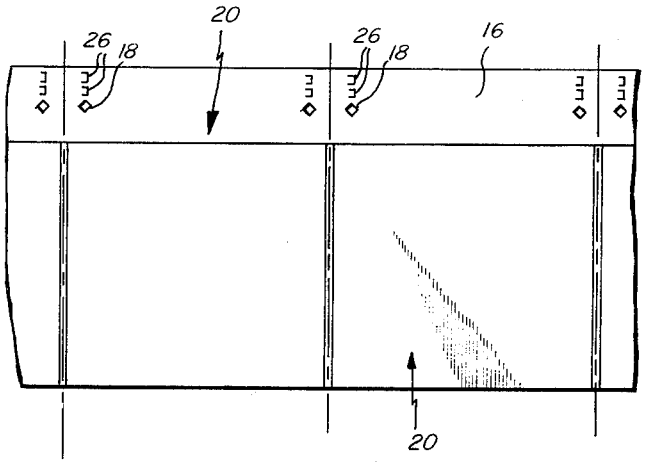
FIG. 2 is an illustration of the web after it has been formed to define a sequence of individual bags having wicket holes punched therein.

FIG. 1 shows a typical environment in which the invention may be employed. The web, indicated generally by the reference character 10, may be of any type of sheet material which is advanced along a direction as indicated by the arrow 12. The web 10 may have been folded and sealed at spaced locations 14 along the length of the web to define a series of bag-like pockets. They may be formed to leave a single thickness margin 16 in which the wicket holes 18 may be formed. The web 10 then may be served along each of the sealed locations 14 to form a plurality of individual bags 20.

Figure 3:
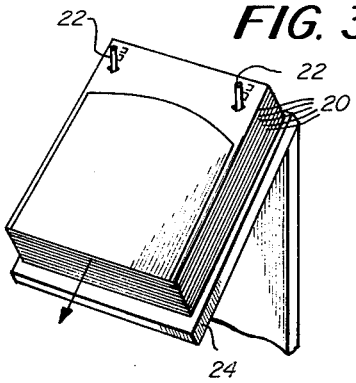
FIG. 3 is an illustration of a plurality of bags hanging from the wickets.
Figure 4:
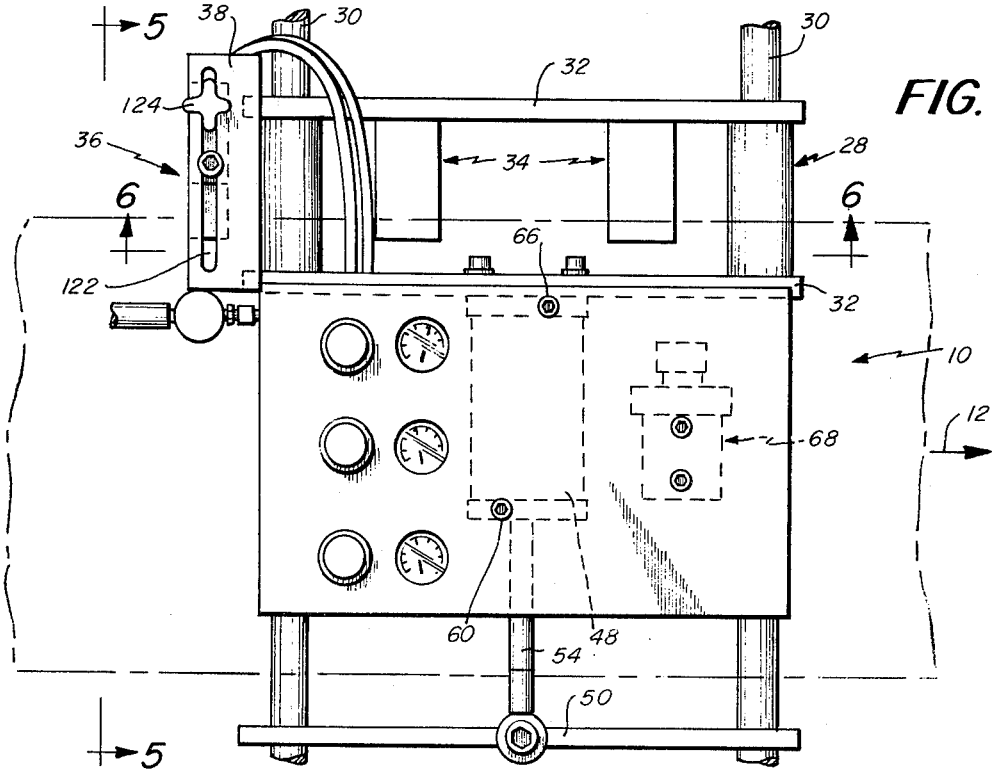
FIG. 4 is a plan view of the carriage.

FIG. 3 shows the manner in which a plurality of such bags may be stacked and retained on a pair of wickets 22 in readiness to be filled individually and then separated from the wickets 22. The bags 20 may be rested on a downwardly inclined plate 24 so that the uppermost bag in the stack has its pocket exposed. The pocket may be opened either by an air blast or manually to orient the bag in a product-receptive configuration as suggested in FIG. 3. After the product to be packaged has been inserted into the pocket, either manually or by an automatic loading machine, the filled bag is urged downwardly to tear the bag from the wickets 22. In this regard it may be noted that the wicket holes preferably include the punched hole 18 as well as one or more slots 26 to facilitate the direction in which the bag is torn from the wickets 22 as well as to insure that the bag will be separated from both wickets at the same time. It will therefore be appreciated that proper location of the wicket holes 18 and slots 26 is extremely important to insure that the bags 20 will not separate from the wickets 22 prematurely as well as to insure that when it is desired to separate them, they will separate in the intended manner.

FIGS. 4–7 show in more detail the various features of the carriage, hole punching apparatus and pneumatic control system employed in accordance with the invention. The carriage indicated generally by the reference character 28 is mounted for movement transversely toward and away from the direction of travel 12 of the web 10, for example, by mounting it for such movement on a pair of transversely extending rails 30. The carriage 28 includes at least one and preferably a pair of cross pieces 32 to which may be securely mounted one or more hole punching mechanisms 34 or other work performing mechanisms as the case may be. By way of example, punches of the type shown in U.S. Pat. No. 3,524,368 may be employed. The carriage 28 also supports a pneumatically operated edge proximity sensor 36 which may depend from a bracket 38 secured to the carriage. The edge proximity sensor 36 includes a pair of spaced fingers 40 which define a web-receptive slot 42 therebetween through which the marginal edge of the web advances. Each of the fingers 40 has a hole 44, 46 formed therein, the holes 44, 46 facing each other and being in registry. One of the holes 46 is in communication with a source of air under pressure and the other hole 44 is in communication with the pneumatic control system to control the position of the carriage on the rails as will be described. Movement of the carriage 28 either toward or away from the web is dependent on how much, if any, of the holes 44, 46 are blocked by the edge of the web. Thus, if the holes 44, 46 are completely blocked by the edge of the web the carriage and, therefore, the mechanism 34 is too close to the web and the carriage will be driven away from the web. Conversely, if too little of the holes 44, 46 are blocked, the carriage will be urged toward the web.

The carriage is driven by a pneumatic cylinder 48, one end of which is secured to a cross piece 32 of the carriage. The outwardly extending piston rod 54 is secured to the rails 30 as by a cross piece 50. The carriage also may have mounted to it the various pneumatic control devices, valves, regulators, etc., which will be described below.

FIG. 7 shows the pneumatic control for the device. The pneumatic cylinder 48 has a piston 52 and piston rod 54, the piston rod being secured to the cross piece 50 and the other end of the cylinder 48 being suitably secured to the carriage. The piston 52 thus divides the cylinder 48 into a first chamber 56 and a second chamber 58. Air under pressure is continually applied to chamber 58 of cylinder 48 to continually bias the carriage 28 toward the edge of the web. This may be accomplished by connecting chamber 58 through line 60 and pressure regulator 62 to a suitable source of air under pressure indicated generally by the letter S. By way of example, regulator 62 may be set to apply a pressure of the order of 35 psi to the chamber 58. It may be noted here that pressure regulator 62 is of the self relieving variety in which, when the cylinder 48 is operated to reverse its direction, air may be exhausted through lines 60 and regulator 62 sufficiently to maintain the desired constant pressure level in the chamber 58.

The other chamber 56 of cylinder 48 is maintained under pressure from the source S through pressure regulator 64 and line 66. Regulator 64 is pre-set so that normally it will apply a pressure to chamber 56 to precisely counter balance the effect of the pressure in chamber 58 thus resulting in a normal configuration in which the cylinder 48 remains stationary to maintain the carriage stationary. Operation of the pneumatic cylinder 48 to move the carriage in either direction is controlled by increasing or decreasing the pressure in chamber 56 of the cylinder 56. Variation in the pressure in chamber 56 is controlled by an amplifier valve indicated generally at 68 which is connected to line 66 through line 70. Valve 68 is designed to open or close line 70 and therefore control the extent to which line 66 and chamber 56 are vented to exhaust. As will be described, valve 68 normally is partly opened so there will always be some exhaust air flow through line 70. In order to maintain the carriage stationary when in the "normal position", the pressure regulator 64 must be set to a slightly higher pressure than that which exists within chamber 58. Thus, further opening of the valve 68 will reduce the pressure in chamber 56 and cause the carriage to move toward the web while further restriction of the valve 68 will increase the pressure in chamber 56 and cause the carriage to be urged away from the web. The valve 68 is controlled by the output from the edge proximity sensor 36 through line 72 which is connected to the input of the valve. In this regard one of the holes 46 in the sensor 36 is connected through line 74 to a pressure regulator 76 which receives air under pressure from a suitable source S. Regulator 76 is set to a relatively low pressure (for example under 10 p.s.i.) but should be at least sufficient so that air flowing from the hole 46 may develop a sufficiently increased or decreased static pressure in line 72 to control operation of the valve 68.

The valve 68 includes a housing 78 having a bore 80 which slidably receives a spool 82. The bore 80 is closed at one end by an end cap 84 and at the other end by an intermediate wall 86. The spool 82 is biased toward the intermediate wall by a spring 88. The spool has a land 90 and the length of the spool is such that when the spool is in a normal configuration, the land 90 will partly obstruct an inlet port 92 formed through the valve housing 78. Valve housing 78 also includes an outlet port 94 which is in communication with the annular chamber 96 defined at one side of the land 90. Movement of the spool 82 within the bore 80, to control the extent to which port 92 is exhausted through the valve and thereby control the extent and direction of movement of the cylinder 48 is effected by an actuator 98 located on the other side of the intermediate wall 86 and which protrudes through a receptive hole 100 in the wall 86. The actuator 100 is mounted to a flexible diaphragm 102 preferably by means of a relatively rigid central portion of the diaphragm indicated in the form of a disk at 104. The diaphragm 102 is securely retained within a diaphragm chamber 106 which is defined by a diaphragm housing 108 secured to the other side of the intermediate wall 86. The diaphragm 102 may be mounted by securing its peripheral margin between the peripheral junction of the diaphragm housing 108 and intermediate wall 86. The other end of the diaphragm housing 108 is threaded to receive an adjustable end cap 110. The diaphragm 102 is biased toward the intermediate wall 86 in a direction tending to cause the actuator 98 to urge the spool 82 in an opposite direction by the spring 112. The force with which the spring 112 acts on the diaphragm 102 may be varied by threaded adjustment of the cap 110. The diaphragm chamber 106 is connected to line 72 for example, by an inlet port 114 which may be formed in the cap 110 or other convenient location in the diaphragm housing 108.

The valve 68 also includes a feedback arrangement which enables rapid response of the valve 68 and similar rapid control of the pneumatic cylinder 48 yet which reduces the tendency of the system to overshoot and therefore hunt. The feedback system includes primary feedback passage 116 which connects the output port 94 to the intermediate chamber 118 on the spool side of the diaphragm. A secondary feedback conduit 120 is connected from the outlet port 94 to the bore 80 on the opposite side of the land 90 of the valve spool 82. The exhaust outlet port 94 is provided with a variable flow restrictor 95 to provide further control in the balancing of the system.

In operation, the various pressure regulators are set to their intended operating pressures as described above and the threaded cap 110 and flow restrictor 95 are properly adjusted so that the springs 88 and 112 will cooperate to bias the spool 82 so that the port 92 is slightly open and in a "normal" configuration when the edge of the web intersects and blocks off half of the area of the holes as suggested in FIG. 8. As long as the edge of the web overlies half the area of the holes, the system will remain balanced and there will be no change in the pressure in chamber 56, thus maintaining the carriage in the same position. When the system is in this configuration, the additive forces of the spring 112 and the slightly increased air pressure in chamber 106 balance the combined forces of spring 88, the air pressure in bore 80 from feedback line 120 and the air pressure in the portion 118 of the diaphragm chamber 106. Flow restrictor valve 95 should be properly set in conjunction with the adjustment of the force of spring 112 to effect the desired balance. Thus, when in a "normal" configuration, the end of the spool 82 bears against the end of the actuator 98 which projects just slightly beyond the hole 100 and port 92 is open just enough to equalize the forces acting on piston 52.

If the moving web begins to draw away from the carriage this will effectively open the flow area of the holes 44, 46 which will result in a slightly increased static pressure in line 72 and in diaphragm chamber 106. This imbalance of the forces acting on the diaphragm 102 urges the diaphragm slightly toward the intermediate wall 86 to cause the actuator 98 to urge the spool 82 to increase the opening of the inlet port 92. This, in turn, enables an increase in the rate of flow through lines 70 and exhaust outlet port 94 which results in a pressure drop in line 66 and, consequently, chamber 56. It may be noted that while this increased flow and resultant pressure drop ordinarily would be compensated by pressure regulator 64, a restriction 65 is located at the outlet of regulator 64 to effect a time delay in the rate at which the regulator 64 increases the air supply to the system. The delay is sufficient to permit the above described pressure crop in chamber 56 to operate the cylinder 48 and draw the carriage toward the web. It should be noted that the speed at which the cylinder 48 is actuated is dependent upon the rate at which the shifting web unblocks the holes 44, 46. A relatively rapid rate of withdrawal of the edge of the web from its intersecting relationship with the holes will result in a correspondingly rapid rate of pressure increase in chamber 106 and correspondingly more rapid movement of the spool 82. Also, the distance which the spool 82 moves in its bore 80 corresponds to the magnitude of the shifting of the web from its "normal" position. The greater the movement of the spool 82, the larger will be the opening 92 and the greater the pressure drops in chamber 56.

In order for the system to function effectively it is important that the rate of movement of the carriage decreases as the carriage begins to approach the new desired position. In order to insure that the carriage does not overshoot, which would result in a series of continually reversing hunting movements, the primary and secondary feedback lines 116, 120 are employed to continually resist an increase in the opening of port 92. The magnitude of the resistance to further opening of the port 92 is a direction function of the extent to which port 92 is opened which, in turn is a function of the proportion of the holes 44, 46 which remains unblocked. Thus, where the edge of the web is so far displaced that it completely unblocks the holes, the diaphragm 102 will be subjected to its maximum possible pressure in chamber 106 thus tending to open inlet port 92 to its maximum. This, however, results in an increased pressure in line 94 which is transmitted through line 116 to resist movement of the diaphragm and also through line 120 to resist movement of the spool 82. As the carriage moves toward the web and the edge of the web begins to obstruct the holes 44, 46, the spool 82 is permitted to move back toward its normal position thus increasing the obstruction in the line 92 and thereby progressively decreasing the pressure applied to the diaphragm 102 and spool 82 by the feedback lines 116, 120.

Conversely, when the carriage is too close to the edge of the web, the holes 44, 46 will be blocked completely resulting in a pressure drop within chamber 106 which enables the slightly stronger spring 88 to overcome the effect of spring 112, thus enabling the spool 82 to be urged fully toward the intermediate wall so that its land 90 completely blocks the inlet port 92. With flow through line 70 thus precluded, the pressure in chamber 56 of pneumatic cylinder 48 is raised to the level of the pressure regulator 64, which is slightly more than that which is in chamber 58, to drive the carriage away from the web. As mentioned above during this motion, the volume of chamber 58 is progressively decreased. While this normally would raise the pressure in that chamber regulator 62 which is of the self-relieving variety enables air to bleed back through line 60 through regulator 62 and to the atmosphere thus maintaining the pressure within chamber 58 at the constant pre-set level of regulator 62. As the carriage moves away from the web and the holes 44, 46 are progressively uncovered, the pressure within chamber 106 begins to increase thus causing an opening movement of the spool to open port 92. As port 92 opens the feedback pressures on lines 116, 120 begins to build up thus resisting and damping the movements of the diaphragm and spool to avoid oscillation and hunting.

The edge sensor 36 preferably is mounted to the carriage so that its position with respect to the hole punchers 34 may be adjusted, thus providing an ability to vary the location of the punched holes with respect to the edge of the web, as may be desired. To this end, bracket 38 may have a slot 122 formed therein. The sensor 36 may be secured in any desired position longitudinally of the slot by means of a bolt 124 which is secured to the sensor 36 and extends upwardly through the slot 122. The upper end of the bolt is threaded to a manually operable handle 124 which may be released to vary the longitudinal position of the sensor 36 and then tighten to secure it in that position.

It should be understood that the foregoing description of the invention is intended to merely be illustrative thereof and that other modifications and embodiments may be apparent to those skilled in the art without departing from its spirit.

Having thus described the invention what I desire to claim and secure by letters patent is:

1. A device for locating a work performing device at a predetermined location with respect to an edge of a moving web comprising:

a carriage mounted for movement toward and away from the edge of the web and in a direction transverse to the direction of movement of the web;

means mounting the work performing device to the carriage for movement in unison therewith;

sensing means mounted to the carriage for sensing transverse movement of the edge of the web from a predetermined position;

drive means for effecting transverse movement of the carriage toward and away from the web, the drive means comprising a pneumatic cylinder including a piston and piston rod, the piston dividing the cylinder into a first chamber and a second chamber, the cylinder and piston rod being connected between the carriage and a stationary member;

means for maintaining the second chamber at a fixed, predetermined pressure;

means for applying air under pressure to the first chamber;

control means for varying the pressure in the first chamber in response to a change in position of the edge of the web from its predetermined position and including means for normally exhausting the first chamber at a predetermined flow rate and for varying the flow rate of the exhaust from said predetermined flow rate; and the pressure applying means in communication with the first chamber of the cylinder being constructed and arranged to supply air at a predetermined pressure and at a flow rate equal to said normal exhaust flow rate whereby the cylinder may be actuated in a direction depending on the relative flow rates of the exhaust from and the pressure applying means to the first chamber.

2. A device as defined in claim 1 further comprising:

the exhaust means being operatively associated with the sensing means to effect variation in the exhaust flow rate in proportion to the extent which the edge of the web is displaced from its predetermined position.

3. A device for locating a work performing device at a predetermined location with respect to an edge of a moving web comprising:

a carriage mounted for movement toward and away from the edge of the web and in a direction transverse to the direction of movement of the web;

means mounting the work performing device to the carriage for movement in unison therewith;

sensing means mounted to the carriage for sensing transverse movement of the edge of the web from a predetermined position;

drive means for effecting transverse movement of the carriage toward and away from the web, the drive means comprising a pneumatic cylinder including a piston and piston rod, the piston dividing the cylinder into a first chamber and a second chamber, the cylinder and piston rod being connected between the carriage and a stationary member;

means for maintaining the second chamber at a fixed, predetermined pressure;

means for applying air under pressure to the first chamber;

control means for varying the pressure in the first chamber in response to a change in position of the edge of the web from its predetermined position and including means for normally exhausting the first chamber at a predetermined flow rate and for varying the flow rate of the exhaust from said predetermined flow rate; and the pressure applying means in communication with the first chamber of the cylinder being constructed and arranged to supply air at a predetermined pressure and at a flow rate equal to said normal exhaust flow rate whereby the cylinder may be actuated in a direction depending on the relative flow rates of the exhaust from and the pressure applying means to the first chamber;

said means for varying the flow rate of the exhaust from said predetermined flow rate comprising, in combination:

a control valve having an inlet and an exhaust outlet, the inlet being connected to the first chamber of the cylinder;

a valve member movable to open, to close, or to partly obstruct flow through the valve from the inlet to the outlet;

bias means for normally positioning the valve member in a partly obstructing relation to effect the predetermined exhaust flow rate when the web is in its predetermined position; and the sensing means being connected to the control valve to imbalance the bias means in response to transverse shifting of the web and to urge the valve member to change its degree of obstruction to flow through the valve thereby changing the exhaust flow rate and actuating the cylinder.

4. A device as defined in claim 3 further comprising:

feedback means for applying the pressure in the exhaust outlet to the valve member in a direction as to apply a resisting force to the movement of the valve member, the magnitude of the resisting force being proportional to the force tending to cause the movement of the valve member.

5. A device as defined in claim 3 further comprising:

the sensor being constructed and arranged to provide an output of variable air pressure;

the control valve including a housing having a bore, the valve member being movable in the bore; and bias means acting on opposite sides of the valve member, the bias means on one side of the valve member comprising a spring and the bias means on the other side of the valve member comprising another spring and the force of the pressure from the sensing means.

6. A device as defined in claim 5 further comprising:

air pressure feedback means for communicating and applying the exhaust air pressure to said one side of the valve member and in a magnitude which is proportional to the output of the sensing means.

7. A device as defined in claim 6 wherein the control valve further comprises:

a housing having an end wall;

an intermediate wall secured to the other end of the housing, the intermediate wall having a hole formed therethrough;

a diaphragm chamber secured to the other side of the intermediate wall;

a flexible diaphragm mounted in the diaphragm chamber and being spaced from the intermediate wall, the diaphragm being movable toward and away from the diaphragm wall;

an actuating member secured to the diaphragm and extending through the hole in the intermediate wall for engagement with the other end of the valve member;

the bias on the other end of the valve member comprising said another spring bearing against the diaphragm to urge the actuator against the valve member;

the output from the sensor means being connected to the diaphragm chamber; and the feedback means comprising means communicating the exhaust pressure to the bore on one side of the valve member and means connecting the exhaust pressure to the space between the diaphragm and the intermediate wall.

* * * * *